United States Patent [19]

Harada

[11] Patent Number: 4,669,432

[45] Date of Patent: Jun. 2, 1987

[54] SEALING DEVICE FOR AN OIL PAN ADAPTER IN AN INTERNAL COMBUSTION ENGINE

[75] Inventor: Yasuo Harada, Oyama, Japan

[73] Assignee: Kabushiki Kaisha Komatsu Seisakusho, Tokyo, Japan

[21] Appl. No.: 863,903

[22] Filed: May 16, 1986

[51] Int. Cl.[4] ..... F02B 77/00

[52] U.S. Cl. ..... 123/198 E; 123/196 R; 123/195 C; 184/106; 277/235 B

[58] Field of Search ..... 123/196 R, 198 E, 195 C; 184/106; 277/235 B, 12, 32

[56] References Cited

U.S. PATENT DOCUMENTS

| | | | |
|---|---|---|---|
| 4,023,547 | 5/1977 | Reisacher | 123/195 R |
| 4,118,041 | 10/1978 | Feitamura | 277/235 B |
| 4,121,557 | 10/1978 | Congram et al. | 123/195 C |
| 4,202,311 | 5/1980 | Moriyoshi | 123/195 C |
| 4,203,409 | 5/1980 | Fachbach et al. | 123/195 C |
| 4,394,853 | 7/1983 | Lopez-Crevillen et al. | 123/195 C |
| 4,411,227 | 10/1983 | Feichtinger | 123/195 C |
| 4,428,338 | 1/1984 | Skatsche et al. | 123/195 C |
| 4,480,608 | 11/1984 | Valev | 123/195 C |
| 4,492,189 | 1/1985 | Ogawa et al. | 123/195 C |
| 4,577,713 | 3/1986 | Moon | 123/198 E |

*Primary Examiner*—E. Rollins Cross

*Attorney, Agent, or Firm*—Armstrong, Nikaido, Marmelstein & Kubovcik

[57] ABSTRACT

An oil pan adapter in the form of a rectangular frame with transverse reinforcing ribs is mounted to the underside of a cylinder block both for the higher adaptability for the installation of various type oil pans and for noise reduction through the damping of cylinder block vibration. One of the opposite end faces of the oil pan adapter is held against a flywheel housing mounted to one end of the cylinder block. For fluid tightly sealing this end face of the oil pan adapter, there is formed therein a generally U shaped groove including a pair of vertical limbs each having a horizontal limb joined to its top end. Each horizontal limb is open not only toward the flywheel housing but also toward the cylinder block. A sealing strip of matching shape and size is engaged in this U shaped groove to be held against both the flywheel housing and the cylinder block.

4 Claims, 4 Drawing Figures

SEALING DEVICE FOR AN OIL PAN ADAPTER IN AN INTERNAL COMBUSTION ENGINE

BACKGROUND OF THE INVENTION

This invention relates to internal combustion engines and more specifically to those having an oil pan adapter between the cylinder block and the oil pan. Still more specifically, the invention pertains to a device for sealing the oil pan adapter against the leakage of fluids such as lubricant and blowby.

The cylinder block, as well as the fly-wheel housing and timing gear case on its opposite ends, of a multicylinder internal combustion engine has long been coupled directly to the underlying, detachable oil pan, which is made of sheet metal, only with a gasket or gaskets interposed therebetween for fluid tightly sealing the joint. Recently, however, it has been suggested to interpose an oil pan adapter, in the form of a rigid, rectangular frame with a transverse reinforcing rib or ribs, between cylinder block and oil pan. The oil pan adapter serves the following two functions:

1. To make possible the easier mounting of oil pans of various shapes or sizes as required by the intended engine applications.

2. To suppress the engine noise through the damping of the vibration of the flared lower part of the cylinder block (or the upper part of the crankcase), the sheet metal oil pan being incapable of this function.

A problem has been encountered with the sealing of the oil pan adapter as the latter is joined not only to the cylinder block but also to the fly-wheel housing and timing gear case. It has been suggested, for example, to make the bottom ends of the cylinder block, fly-wheel housing and timing gear case flush with one another and to mount the oil pan adapter to these flush surfaces via a gasket or gaskets. Although the complete bottom ends of the cylinder block and timing gear case can be made flush, the fly-wheel housing can have only part of its bottom end formed into coplanar relation with the bottom ends of the other two because of the position of the fly-wheel with respect to the engine cylinders. Inevitably, therefore, the thickness or axial dimension of the fly-wheel housing has had to be increased, imposing limitations on the design of the engine output shaft and other parts.

It has also been known to arrange the fly-wheel housing and timing gear case sidewise against the opposite ends of the oil pan adapter, with the latter having its top edges held only against the cylinder block. In this case the dimension of the cylinder block in the axial direction of the crankshaft must be exactly equal to that of the oil pan adapter. Consequently, unless the oil pan adapter have been manufactured to very stringent dimensional tolerances, difficulties have been encountered in the assemblage the engine.

Still further, for sealing the joints among the cylinder block, oil pan adapter and fly-wheel housing, it has been proposed to form a continuous surface on the fly-wheel housing which surface has a built in seal to be held against both cylinder block and oil pan adapter. The joint between cylinder block and oil pan adapter has been sealed by a gasket which is partly cut off to butt on the fly-wheel housing. Further, at the point where the joint between cylinder block and oil pan adapter terminates and meets the fly-wheel housing, a pair of straight sealing strips of rectangular cross section have been employed which are engaged respectively in a pair of aligned grooves cut horizontally in the upper edge of that end surface of the oil pan adapter which is opposed to the fly-wheel housing. This conventional sealing method has the following disadvantages:

1. The seal on the fly-wheel housing is easy to be ruined by the oil pan adapter during the mounting and dismounting of the latter, with the consequent need for the detachment of the fly-wheel housing from the cylinder block for the replacement of the ruined seal 2. The additional trouble is required of partly cutting off the gasket between cylinder block and oil pan adapter.

3 The pair of sealing strips on the oil pan adapter directly engages the cylinder block but engages the fly-wheel housing via the seal built into the latter, with the possibility of leakage through the butting surfaces of the seals on the oil pan adapter and the fly-wheel housing.

SUMMARY OF THE INVENTION

The present invention provides a solution to the problem of how to seal the joint formed by the cylinder block, fly-wheel housing and oil pan adapter in an internal combustion engine of the type defined.

According to the invention, stated in brief, the oil pan adapter has a generally U shaped groove in its end face held opposite the fly-wheel housing. The groove includes a pair of vertical limbs each having a horizontal limb joined to its top end, each horizontal limb being open both toward the cylinder block and toward the fly-wheel housing. The groove has engaged therein a sealing strip of corresponding shape and size, which can be held both against the cylinder block and the fly-wheel housing for fluid tightly sealing the joints between these engine components and the corner of the oil pan adapter.

The above and other features and advantages of this invention and the manner of realizing them will become more apparent and the invention itself will best be understood, from a study of the following description and appended claims, with reference had to the attached drawings showing some preferable embodiments of the invention.

DESCRIPTION OF THE PREFERRED EMBODIMENTS

Figure 1:
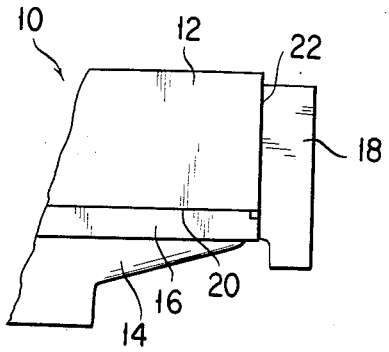
FIG. 1 is a fragmentary, diagrammatic side elevation of an Internal combustion engine having the improved sealing means of this invention.

The internal combustion engine 10 shown diagrammatically in FIG. 1 includes a cylinder block 12 having a sheet metal oil pan 14 mounted to its underside via an oil pan adapter 16. A fly-wheel housing 18 is held against one end of the cylinder block 12 and that of the oil pan adapter 16. The joint between cylinder block 12 and oil pan adapter 16 may be sealed by a liquid seal or a usual gasket 20. The joint between cylinder block 12 and fly-wheel housing 18 may likewise be sealed by a liquid seal or a usual gasket 22. This invention is not to be limited by the specific means employed for sealing these joints.

Figure 2:
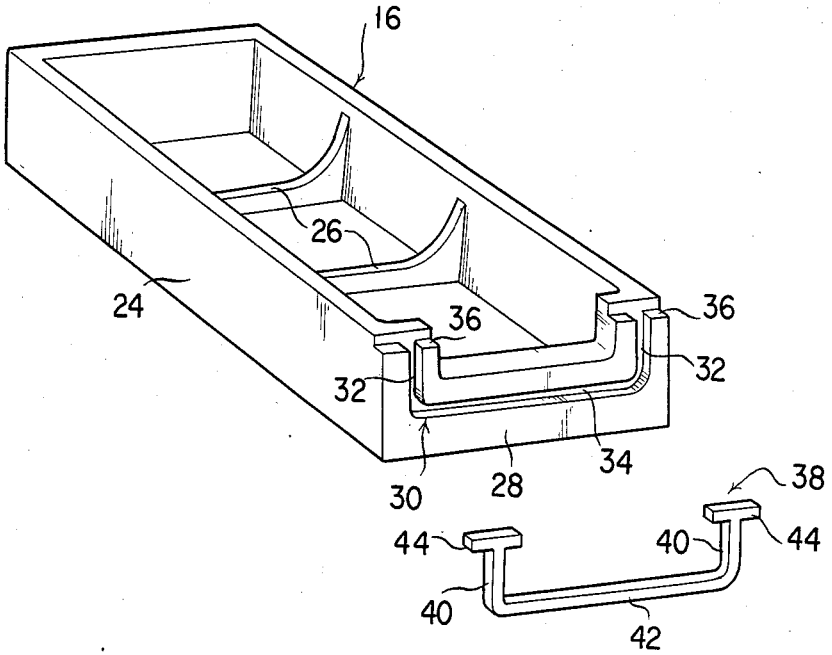
FIG. 2 is an enlarged perspective view of the oil pan adapter and sealing strip, shown detached from each other, which are both included in the engine of FIG. 1 and which are constructed in accordance with the novel concepts of this invention.

As illustrated on an enlarged scale in FIG. 2, the oil pan adapter 16 comprises a rectangular frame 24 and one or more reinforcing transverse ribs 26 joining the two longer sides of the frame. One of the two shorter sides of the frame 24 provides an end face 28 disposed opposite part of the fly-wheel housing 18. fined in this end face 26 of the oil pan adapter 16 is a generally U shaped groove 30 comprising a pair of vertical limbs 32 and a horizontal limb 34 joining the bottom ends of the vertical limbs. Further, each vertical limb 32 has its top end joined to a horizontal limb 36 of comparatively short extent, which is open not only laterally, or toward the fly-wheel housing 18, but also upwardly, toward the cylinder block 12.

The generally U shaped groove 20 has engaged therein a sealing strip 38 of corresponding shape and size. Thus the sealing strip 38 is also generally U shaped, comprising a pair of vertical limbs 40, a horizontal limb 42 joining the bottom ends of the vertical limbs, and an additional pair of horizontal limbs 44 joined to the top ends of the respective vertical limbs. The pair of vertical limbs 40 of the sealing strip 38 are of course received in the pair of vertical limbs 32 of the groove 30, the horizontal limb 42 in the horizontal limb 34, and the pair of horizontal limbs 44 in the horizontal limbs 36.

When the oil pan adapter 16 is mounted in place on the internal combustion engine 10, the sealing strip 38 makes fluid tight contact not only with the fly-wheel housing 18 but also with the cylinder block 12.

A preferred material of the sealing strip 38 is a mixture of ground cork and rubber in view of the ease of manufacture and of mounting on the oil pan adapter 16. Made of this material, the sealing strip can have a normal cross sectional size of from about 100 to about 120 percent of the cross sectional size of the U shaped groove 30. By the "normal" cross sectional size of the sealing strip 38 is meant the size when the sealing strip is uncompressed, that is, when the oil pan adapter 16 with the sealing strip thereon is not mounted in place on the engine 10. The sealing strip 38 of this material and cross sectional size can be of rectangular cross sectional shape for the performance of its intended functions to the full.

Figure 3:
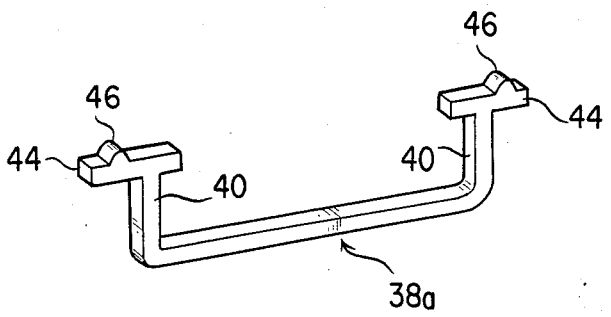
FIG. 3 is a perspective view of an alternative form of the sealing strip in accordance with the invention.

Another possible material of the sealing strip 38 is the rubber of the class employed for familiar O ring seals. However, the normal cross sectional size of the rubber made sealing strip cannot possibly be made more than the cross sectional size of the groove 30. This problem can be overcome by providing an upward protuberance 46 on each horizontal limb 44, as in a modified sealing strip **38*a* shown in FIG. 3**.

Figure 4:
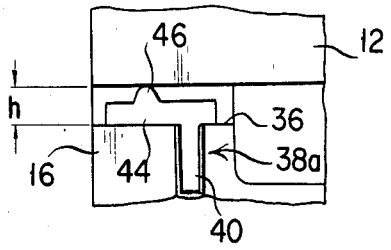
FIG. 4 is a fragmentary elevation of the internal combustion engine having the sealing strip of FIG. 3 mounted in place thereon.

As will be better understood from FIG. 4, the normal cross sectional size of each horizontal limb 44 of the alternative sealing strip **38*a* may be not more than 80 percent of the cross sectional size of the groove 30. The total height of the of each horizontal limb 44 and the protuberance 46 thereon should be greater than, and less than about 120 percent of, the vertical dimension h of each horizontal limb 36 of the groove 30. The thickness (dimension in a direction perpendicular to the end face 28 of the oil pan adapter 16) of each protuberance 46 may be equal to that of the sealing strip 38*a***.

It should be appreciated that the pair of protuberances 46 of the alternative sealing strip **38*a* serve to seal the joint formed by the seal 20 between cylinder block 12 and oil pan adapter 16, the seal 22 between cylinder block 12 and fly-wheel housing 18, and the rest of the sealing strip 38*a* between oil pan adapter 16 and fly-wheel housing 18**.

Each protuberance 46 of the alternative sealing strip **38*a* should be offset from the associated vertical limb 32. Pressed by the cylinder block 12, the protuberances 46 will then serve to enhance the sealing capabilities of the sealing strip 38*a*. Even if the height of the protuberances 46 may be too high in comparison with the vertical dimension h of the groove limbs 36, the groove provides room for the elastic deformation of the sealing strip 38*a*. Therefore, in the fabrication of the sealing strip 38*a*, the dimensional tolerances of the protuberances 46** need not be too small.

Various modificatins of the above disclosed embodiments may be resorted to without departure from the scope of this invention.

What is claimed is:

1. In an internal combustion engine having a cylinder an oil pan under the cylinder block, and a fly-wheel housing mounted to one end of the cylinder block, the improvement comprising:

(a) an oil pan adapter mounted between the cylinder block and the oil pan and having an end face held against the fly-wheel housing;

(b) there being a generally U shaped groove in the end face of the oil pan adapter, the U shaped groove including a pair of vertical limbs each having a horizontal limb joined to its top end, each horizontal limb being open both toward the cylinder block and the fly-wheel housing; and (c) a generally U shaped sealing strip including a pair of vertical limbs each having a horizontal limb joined to its top end, the sealing strip being engaged in the U shaped groove in the end face of the oil pan adapter and fluid tightly held against the fly-wheel housing and the cylinder block.

2. The internal combustion engine of claim 1 wherein the sealing strip is fabricated from a mixture of cork and rubber, and wherein the normal cross sectional size of the sealing strip is from about 100 to 120 percent of the cross sectional size of the U shaped groove.

3. The internal combustion engine of claim 1 wherein each horizontal limb of the sealing strip is formed to include an upward protuberance disposed in offset relation to the associated vertical limb of the sealing strip.

4. The internal combustion engine of claim 3 wherein the sealing strip is fabricated from rubber, and wherein the total vertical dimension of each horizontal limb of the sealing strip and the upward protuberance thereon is more than, and less than about 120 percent of, the vertical dimension of each horizontal limb of the U shaped groove.

* * * * *